US005784906A

United States Patent [19]

Moore

[11] Patent Number: 5,784,906

[45] Date of Patent: Jul. 28, 1998

[54] LOCKING BOLT FOR OVERHEAD SUPPORT OF WEIGHTED ARTICLES

[75] Inventor: Junius T. Moore, Charleston, W. Va.

[73] Assignee: The Moore Company, Inc., Charleston, W. Va.

[21] Appl. No.: 761,775

[22] Filed: Dec. 6, 1996

[51] Int. Cl.[6] ..... E05B 65/00

[52] U.S. Cl. ..... 70/57; 411/400; 248/320

[58] Field of Search ..... 70/2, 6, 14, 18, 70/57, 58, 229, 230; 292/281; 211/44, 117; 248/320–322, 329; 24/116 R; 411/999, 398, 400, 401

[56] References Cited

U.S. PATENT DOCUMENTS

| | | | |
|---|---|---|---|
| 792,594 | 6/1905 | Hiss, Jr. | 411/400 X |
| 1,106,309 | 8/1914 | Joyce et al. | 292/281 X |
| 1,170,106 | 2/1916 | Rockwell | 411/400 X |
| 2,717,562 | 9/1955 | Ewing | 411/400 X |
| 2,962,253 | 11/1960 | Moore, Jr. | 248/320 |
| 3,144,261 | 8/1964 | Stephens | 411/401 X |
| 3,673,719 | 7/1972 | Moore, Jr. | 40/20 R |
| 4,057,211 | 11/1977 | Moore | 248/332 |
| 4,125,241 | 11/1978 | Moore, Jr. | 248/320 |
| 4,402,119 | 9/1983 | Peterson | 248/322 X |

FOREIGN PATENT DOCUMENTS

| | | | |
|---|---|---|---|
| 71212 | 2/1916 | Germany | 411/401 |
| 674845 | 4/1939 | Germany | 411/401 |
| 1067844 | 5/1967 | United Kingdom | 411/401 |
| 1379581 | 1/1975 | United Kingdom | 411/400 |

*Primary Examiner*—Suzanne Dino Barrett

*Attorney, Agent, or Firm*—Cushman Darby Cushman Intellectual Property Group of Pillsbury Madison & Sutro

[57] ABSTRACT

A locking bolt for a storage basket suspension system is provided with a recess for receiving a locking plate with a depending arm extending at an angle of less than 120° and terminating in an eyelet which extends at 90° to the axis of the depending leg portion to prevent or discourage improper installation of the locking plate.

2 Claims, 2 Drawing Sheets

LOCKING BOLT FOR OVERHEAD SUPPORT OF WEIGHTED ARTICLES

BACKGROUND OF THE INVENTION

1. Field of the Invention

The present invention relates to an improved locking bolt for locking a suspension cable at a desired location to control access to an article suspended by the cable.

2. Background Information

The Moore Company of Charlestown, W. Va. has developed an improved and secure storage facility for locker rooms so that workers or others using the locker room can easily store work clothes for any length of time in a condition where the work clothes will be exposed to air flows so as to dry out and/or assist in deodorizing used clothing for subsequent use. In this regard, U.S. Pat. Nos. 2,962,253 and 4,057,211 describe systems utilizing a chain extending over pulleys from one end of which is suspended a storage basket. At the opposite end of the chain is provided a locking facility where a user can securely lock the chain with the basket at an elevated position out of reach of others. Modifications and improvements in the systems of the foregoing U.S. patents, which are commonly assigned, are found in U.S. Pat. Nos. 3,673,719 and 4,125,241. In each of these systems, a locking bolt such as that illustrated in U.S. Pat. No. 3,673,719 has been employed. With such a locking bolt, a locking member has been employed and which is typically fabricated from a single piece of sheet metal and which is provided with a slot which fits over the head of the locking bolt. The insertion of a typical padlock through the eye of the locking bolt serves to secure the locking plate in position so that lowering of the basket cannot be achieved without breaking the lock or cutting the chain.

A difficulty has arisen where a user fails to properly lock the locking plate on the locking bolt. Moreover, in some circumstances where the locking plate is improperly inserted into an unlocked locking bolt, there is a potential hazard created in the event that the locking plate becomes dislodged such as by jostling from adjacent users which can result in the dropping of the storage basket to the floor of the facility.

SUMMARY OF THE INVENTION

It is an object of the present invention to provide a locking bolt that will prevent inadvertent release of the suspension cable for the storage basket even where the user fails to insert a safety lock onto the locking bolt. According to the present invention, this improvement is achieved by providing a locking bolt having a shape such that partial installation of a locking plate on the locking bolt, without a padlock in place, will result in positive engagement of the locking plate with the locking bolt once the plate is engaged with the locking bolt. To this end, the locking bolt free end is shaped to require a twisting path for the locking plate as it is being inserted and that once past the end portion positive locking movement is achieved by gravity action exerted on the cable to move the locking plate to a secure locked position whether or not a physical padlock is attached to the free end of the locking bolt. With this arrangement, it will no longer be possible for an unlocked plate to slip off of the free end of the locking bolt by unintentional accident which could result in uncontrolled descent of the storage basket.

DETAILED DESCRIPTION OF THE INVENTION

Figure 1:
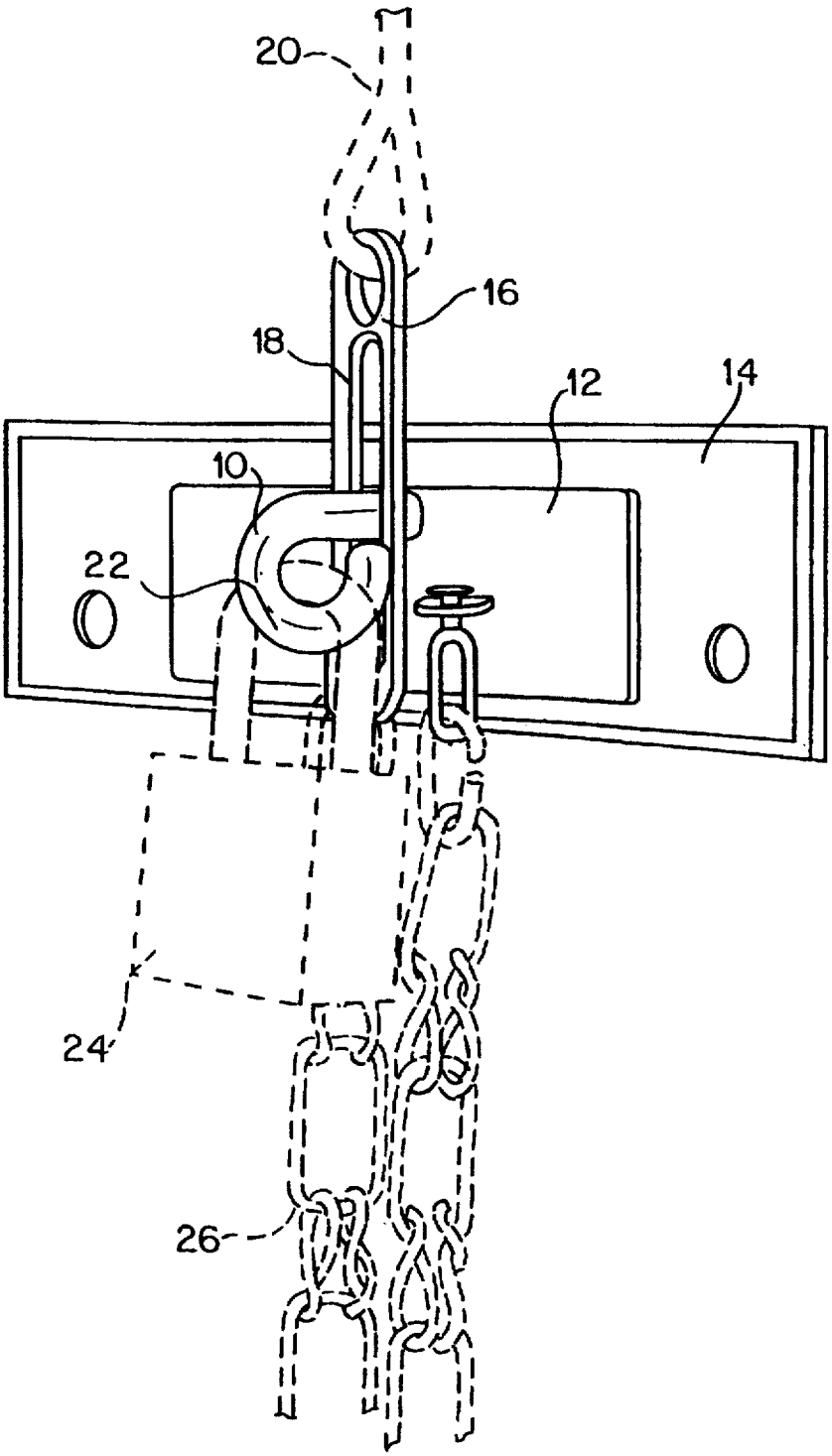
FIG.1 PRIOR ART
FIG. 1 is a perspective view of the locking bolt and locking arrangement of the prior art.
Figure 4:
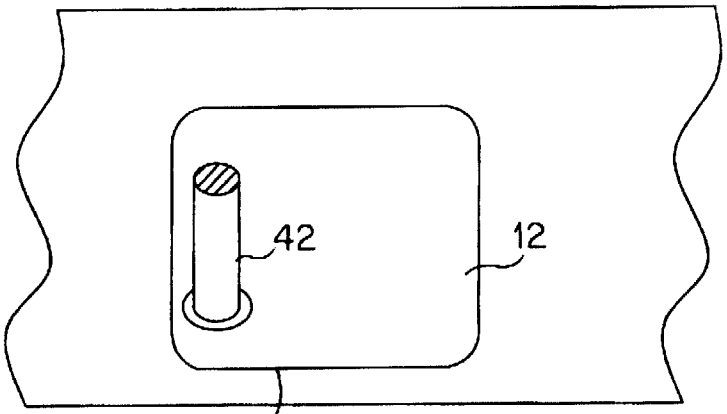
FIG. 4 is a view along lines 4—4 of FIG. 3.

Referring now to the drawings wherein like numerals designate corresponding parts throughout the several views, there is shown in FIG. 1 a locking bolt 10 that has been in use for a number of years in connection with the locker basket storage system of the assignee of the present invention.

In the prior art system of FIG. 1, a mounting plate 12 may be suitably secured to a support rod 14 or other suitable support which may be a wall, rod or securely anchored stand. The locking bolt 10 has a curved eyelet 22 in line with its longitudinal axis (not shown) to facilitate reception of a slot 18 of a locking plate 16. The locking plate typically is securely attached to a lifting cable or chain 20 whereas the opposite end of the locking plate 16 is connected through an eyelet (not shown) to an anchor chain 26 which has its free end anchored to the mounting plate 12. When locked, the locking plate is inserted over the eyelet 22 and a padlock 24 is inserted as shown in FIG. 1. As thus locked, the locking plate 16 cannot be removed over the eyelet 22 without destroying the eyelet or cutting the plate 16.

On some occasions, users who have either, for example, lost their key or forgotten the combination of their padlock 24, install the padlock and then insert the locking plate so that the lower edge of the slot 18 rests on the lowermost curved portion of the eyelet 22. If subsequently jostled or shaken, the locking plate 16 can easily become dislodged from the eyelet 22 resulting in an uncontrolled descent of the storage basket connected to the opposite end of cable 20.

Figure 5:
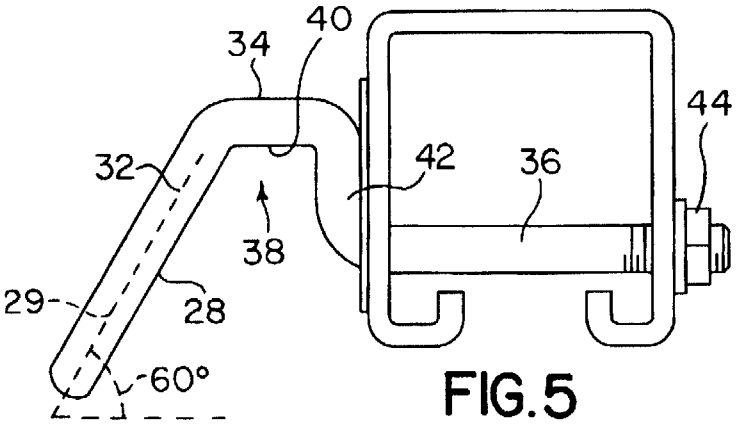
FIG. 5 is a side view of the bolt of FIG. 3.
Figure 2:
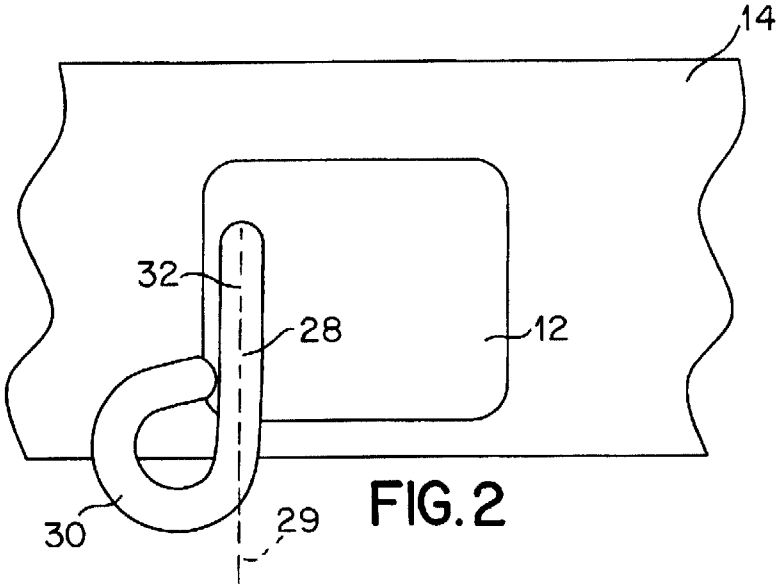
FIG. 2 is a front view and elevation of the locking bolt of the present invention.
Figure 3:
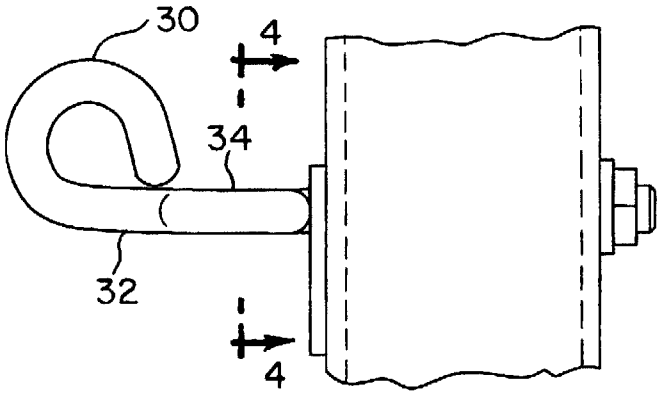
FIG. 3 is a top plan view of the bolt of FIG. 2.

To avoid this, the present invention provides a modified locking bolt 28 as shown in FIGS. 2–5. The locking bolt 28 will have an angled descending leg portion 32 which terminates in an eyelet 30 which extends away from the axis 29 of the leg portion 32 as shown in FIGS. 2 and 3 but in a plane extending through the axis 29. The leg portion 34 extends substantially perpendicular to the root portion 36 of the locking bolt 28 as shown in FIG. 5 but is offset from the axis of the root portion 36 to provide a notch or recess 38 having an elongated flat portion 40 as shown in FIG. 5. The depth of the notch 38 can be regulated by extending the inner leg portion 42 before effecting the bend in manufacture to define the leg portion 34. The leg portion 32 should extend from leg portion 34 at an angle that is greater than 90° but less than about 120°.

With this arrangement, when the locking plate 18 is installed, it will not be possible to attach the locking plate when a lock is in place through the eyelet 30 due to the angled position of the eyelet 30 both with respect to the horizontal (at approximately 60° as shown in FIG. 5) and as well as to the axis 29 of the leg portion 32.

It will be appreciated that the nut 44 will be welded in place to prevent unauthorized removal of the locking bolt 28 once installed.

Having described the invention, it will be apparent to those skilled in the art that various modifications may be made therein without departing from the spirit and scope of this invention as defined in the appended claims.

What is claimed is:

1. A locking bolt for securing members in place, said bolt having a root portion insertable through a support member, said root portion having a longitudinal axis, a first leg portion extending at an angle to said root portion, a second leg portion extending from said first leg portion in a direction parallel to said longitudinal axis of said root portion and a third leg portion extending from said second leg portion at a selected angle that is less than 120°, said third leg portion terminating in an eyelet having an opening for receiving a locking member with said eyelet spaced a distance from said root portion by means of said leg portions whereby a locking plate having an opening is insertable onto said second leg portion over said third leg portion and retained on said second leg portion when a locking member is locked in said eyelet.

2. The invention as claimed in claim 1 wherein said eyelet extends in a plane that passes through said third leg portion.

* * * * *